US005664467A

United States Patent [19]

Breeze

[11] Patent Number: 5,664,467

[45] Date of Patent: Sep. 9, 1997

[54] ADJUSTABLE SOCKET

[76] Inventor: Robert W. Breeze, 15 Fairwood Dr., Keswick, Canada, L4P 3S2

[21] Appl. No.: 585,140

[22] Filed: Jan. 11, 1996

[51] Int. Cl.[6] ..... B25B 13/30

[52] U.S. Cl. ..... 81/114; 81/53.2

[58] Field of Search ..... 81/111, 112, 113, 81/114, 115

[56] References Cited

U.S. PATENT DOCUMENTS

| | | | |
|---|---|---|---|
| 1,815,500 | 7/1931 | Doan | 81/114 |
| 2,050,005 | 8/1936 | Heegeman | 81/114 |
| 2,086,587 | 7/1937 | Thomson | 81/114 |
| 2,568,788 | 9/1951 | Bossen | 81/114 |
| 3,735,650 | 5/1973 | Weng, Jr. | 81/53.2 |
| 3,780,604 | 12/1973 | Wood et al. . | |
| 4,366,733 | 1/1983 | Colvin . | |
| 4,378,714 | 4/1983 | Colvin . | |
| 4,431,256 | 2/1984 | Piscitelli et al. . | |
| 4,757,729 | 7/1988 | Martinmaas . | |
| 4,947,712 | 8/1990 | Brosnan . | |
| 4,970,917 | 11/1990 | McCollom . | |
| 5,143,500 | 9/1992 | Schuring et al. . | |
| 5,163,344 | 11/1992 | Mathers . | |

*Primary Examiner*—James G. Smith
*Assistant Examiner*—Joni B. Danganan
*Attorney, Agent, or Firm*—Jeffrey T. Imai; D. Doak Horne; Arne I. Fors

[57] ABSTRACT

An adjustable socket for removing threaded fasteners has a split collet socket, a collet ring and an outer barrel. The split collet ring has at least two fingers. The collet ring is mounted about ends of the fingers. The outer barrel threadably engages the split collet socket and frictionally engages the collet ring. Rotating the barrel relative to the split collet socket in one sense urges the collet ring to close the fingers for gripping a head of the threaded fastener. Continued rotation of the barrel in the one sense increases the grip and applies a torque to the threaded fastener for removal thereof. Counter rotation of the barrel relative to the split collet socket relaxes the collet ring allowing removal of the head of the threaded fastener.

1 Claim, 3 Drawing Sheets

ADJUSTABLE SOCKET

FIELD OF THE INVENTION

This invention relates to a manually operated tool for the removal of threaded fasteners. In particular, this invention relates to an adjustable socket for removing a threaded fastener which has become locked.

BACKGROUND OF INVENTION

Threaded fasteners frequently fail and become locked. The fasteners become locked by rust, corrosion, cross-threading, or through mis-use. Severely rusted fastener heads become smaller with less defined corners. Further, fastener heads are frequently damaged or rounded off. The end result is that the amount of torque which can be applied to the head of the fastener is minimized making removal very difficult.

Conventional tools such as wrenches and sockets cannot remove a failed fastener. Attempts at removal of a failed fastener usually exacerbates the problem by completely stripping the head of the fastener making it impossible to apply the necessary torque to the head. The user must resort to such drastic measures as cutting off the head of the fastener for removal. This usually damages the surface against which the head abuts.

Attempts have been made to provide a means of removing locked fasteners. U.S. Pat. Nos. 3,735,650; 4,366,733; 4,378,714; 4,757,729; 4,947,712; 4,970,917; 5,143,500; and 5,163,344; disclose examples of such devices. The adjustable sockets of the prior art are generally comprised of precision parts and intricate assembly. Accordingly, the devices of the prior are generally expensive limiting commercial success thereof.

SUMMARY OF THE INVENTION

The disadvantages of the prior art may be overcome by providing an adjustable socket which allows the user a means by which a positive method of gripping the damaged or rusted fastener may be obtained.

It is desirable to provide an adjustable socket which is relatively inexpensive and which provides a positive gripping of the damaged or rusted fasteners for removal thereof.

It is desirable to provide an adjustable socket which is compact in size and driven by the standard square drives used by regular sockets.

It is further desirable to provide an adjustable socket which is sized to handle both imperial and metric threaded fasteners.

According to one aspect of the invention, there is provided an adjustable socket for removing threaded fasteners. The socket has a split collet socket, a collet ring and an outer barrel. The split collet ring has at least two fingers. The collet ring is mounted about ends of the fingers. The outer barrel threadably engages the split collet socket and frictionally engages the collet ring. Rotating the barrel relative to the split collet socket in one sense urges the collet ring to close the fingers for gripping a head of the threaded fastener. Continued rotation of the barrel in the one sense increases the grip and applies a torque to the threaded fastener for removal thereof. Counter rotation of the barrel relative to the split collet socket relaxes the collet ring allowing removal of the head of the threaded fastener.

According to another aspect of the invention, there is provided an adjustable socket for removing threaded fasteners. The socket has a split collet socket having at least two cantilevered fingers. Each of the fingers has a taper. A collet ring is mounted about the fingers and has a complementary taper engaging the taper of each of the fingers. An outer barrel threadably engages the split collet socket and frictionally engages the collet ring. The thread of the barrel and the split collet socket are opposite to that of the threaded fastener to be removed. Rotation of the barrel relative to the split collet socket in one sense urges the collet ring to dose the fingers for gripping a head of the threaded fastener, continued rotation of the barrel in the one sense increases the grip and applies a torque to the threaded fastener for removal thereof and counter rotation of the barrel relative to the split collet socket relaxes the collet ring allowing removal of the head of the threaded fastener.

DESCRIPTION OF THE DRAWINGS

In drawings illustrate embodiments of the invention.

DESCRIPTION OF THE INVENTION

Figure 1:
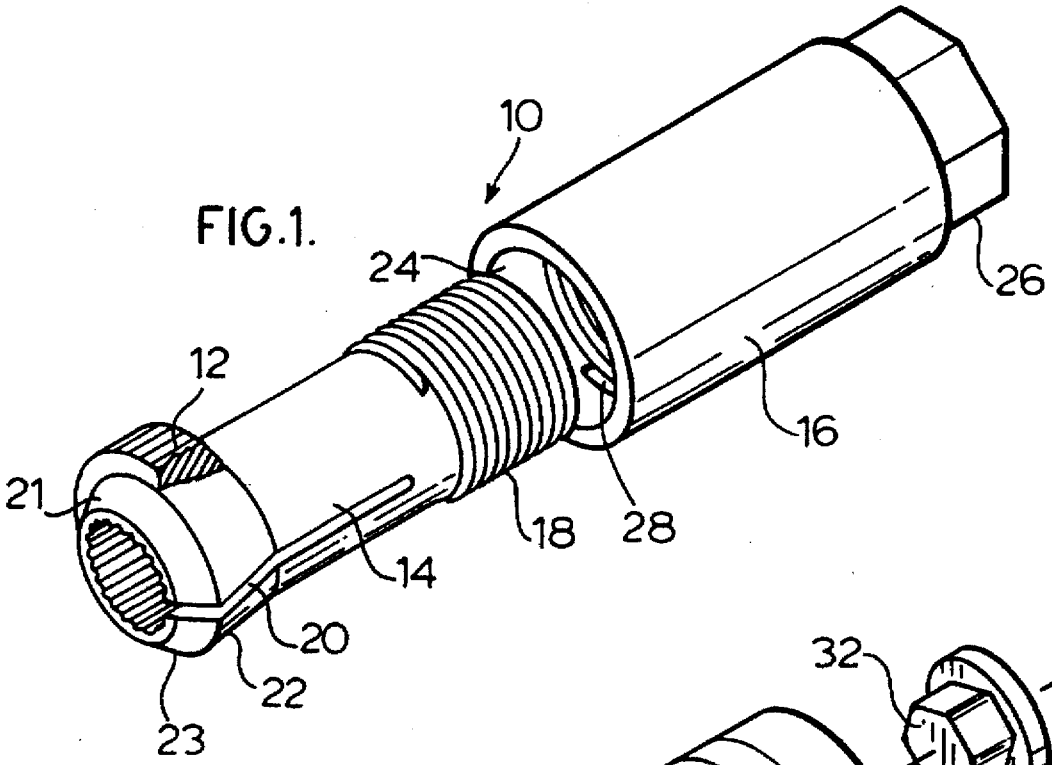
FIG. 1 is an exploded perspective view of the adjustable socket of the present invention.
Figure 2:
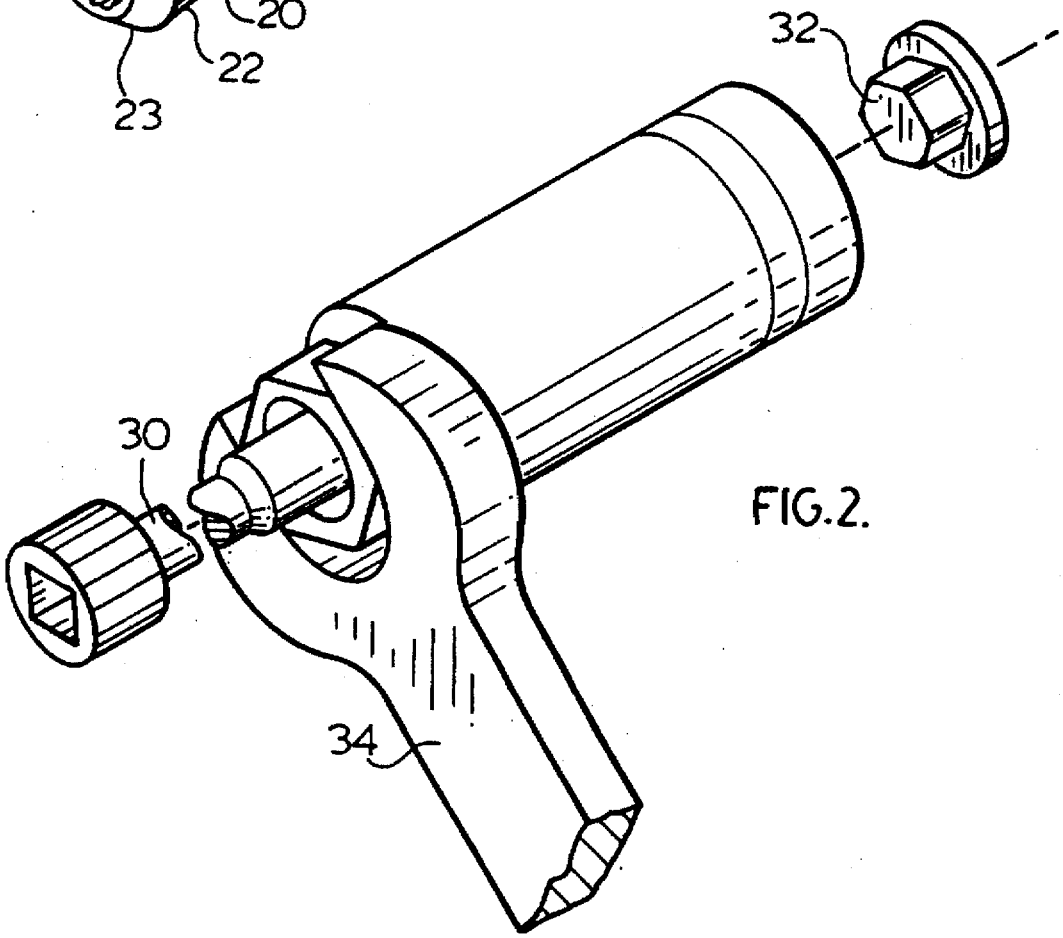
FIG. 2 is an exploded perspective view of the adjustable socket of FIG. 1 illustrating the present invention in use.

The adjustable socket according to the present invention is generally illustrated as 10 in FIG. 1. Adjustable socket 10 comprises a collet ring 12, a split collet socket 14 and an outer barrel 16.

Split collet socket 14 is cylindrical in shape with an axial extending bore. One end of the socket 14 has an external left hand thread 18. The opposite end has at least two slits 20 which extend axially of the socket 14, presenting cantilevered fingers 21 and 23. The opposite end has an outer tapered section 22 which tapers outwardly towards the opposite end.

Collet ring 12 has an internal taper which corresponds to the tapered section 22 for a complementary fit therewith. The outside diameter of collet ring 12 is sized to abut with a rim extending about an open end 24 of barrel 16. The contact surface between the collet ring 12 and the barrel 16 may be minimized to minimize the frictional forces required to move the barrel relative to the split collet socket 14 and engage the collet ring 12.

The tapered section 22 and the internal taper of collet ring 12 are aligned or angled to deflect the fingers 21 and 23 radially inwardly as the collet ring 12 is moved axially along the split collet socket 14. Tapered section 22 is preferably longer than the thickness of the collet ring 12 to allow travel of the collet ring 12 along the tapered section 22.

The diameter of the tapered section 22 at its narrowest point is the same as the outside diameter of the external thread 18. Collet ring 12 is able to slide over the external thread 18 to engage the tapered section 22. Preferably, the collet ring 12 is provided with a knurled surface to improve its grippability.

Barrel 16 has an axially extending bore presenting open end 24. The other end of barrel 16 has a hex nut 26 which is integral with the barrel 16. The bore has an internal left hand thread 28 which is complementary to the external thread 18 of socket 14. Preferably, the barrel 16 is provided with a knurled surface to improve its grippability.

Figure 3:
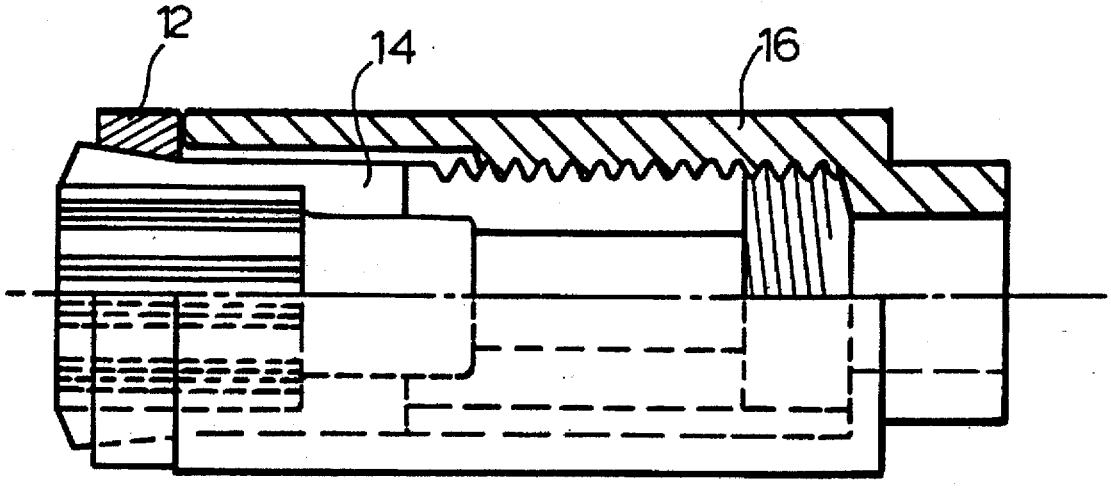
FIG. 3 is a side elevational view, partly in section, of the adjustable socket of FIG. 1.
Figure 6:
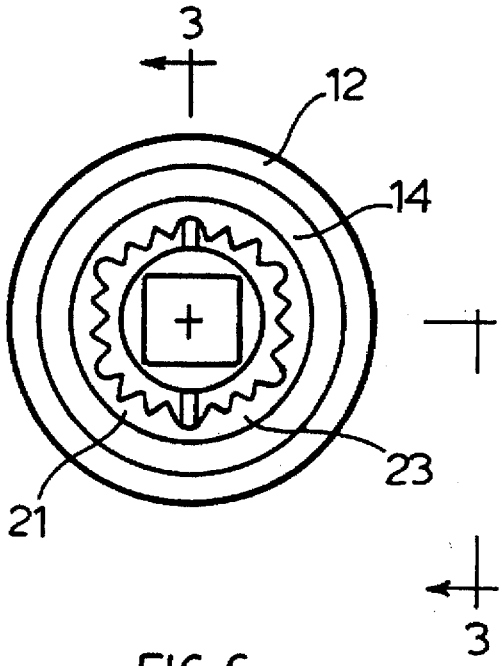
FIG. 6 is an end elevational view of the adjustable socket of FIG. 1, illustrating the end drive.

Referring to FIGS. 3 and 6, the axially extending bore of the split collet socket 14 has a square cross section. The square cross section is sized and adapted to recede a standard drive of a conventional socket wrench driver.

Figure 4:
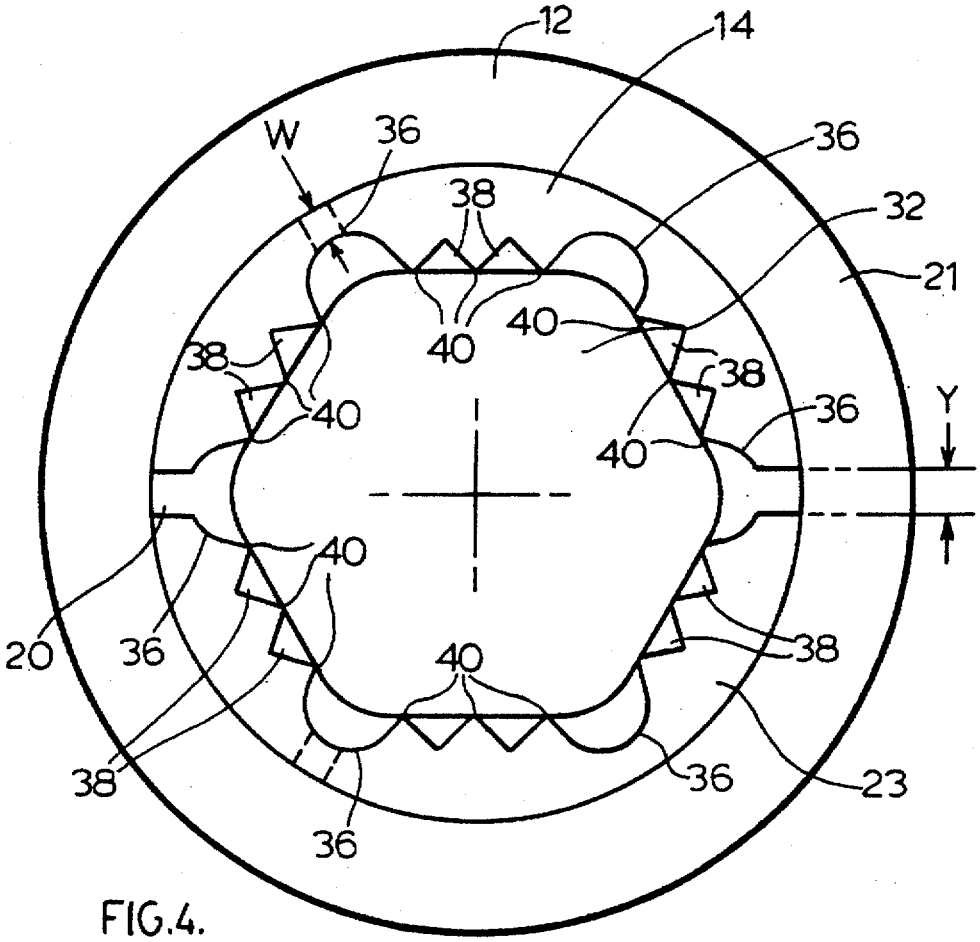
FIG. 4 is an end elevational view of the adjustable socket of FIG. 1.
Figure 5:
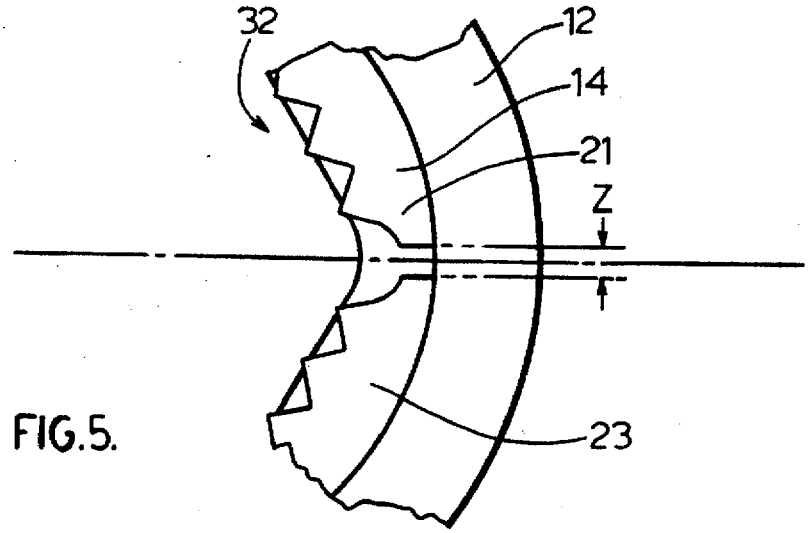
FIG. 5 is a detailed end view of the adjustable socket of FIG. 1.

Referring to FIGS. 4 and 5, the inside perimeter of the fingers 21 and 23 of the split collet socket 14 has jaws of a generally hex shape when viewed from the end. At each of the six comers of the hex, a rounded slot 36 is provided. Between the rounded slots 36, the inside surface of the jaws is serrated or splined defined by axially extending V-shaped slots 38 presenting a series of teeth 40. The side walls of fingers 21 and 23 may be reduced in thickness (W) to allow a degree of flexibility of the teeth 40 allowing the maximum possible grip of the fastener surface.

In use, the user selects the appropriate size of the adjustable socket 10 and the correct standard socket extension 30. The adjustable socket 10 is placed over the head 32 of a threaded fastener and hand tightened, using the knurled exterior on the outer barrel 16. The outer barrel 16 is fully tightened by using a standard wrench 34 on the hex nut 26 of the outer barrel 16. The split collet socket 14 is held in place, preventing relative rotation, by inserting extension 30 into the end 22 of the split collet socket 14 and holding the extension 30 using a ratchet tool and selecting the appropriate direction. This action will force the collet ring 12 further along the tapered end 22 of the split collet socket 14. The fingers 21 and 23 will be deflected and will close around the head 32 of the threaded fastener and the teeth 40 will then indent the surface. When sufficient penetration and grip is established, the user reverses the direction of the drive of the ratchet tool in the end of the socket extension 30. The adjustable socket 10 is rotated as a unit using the ratchet tool or similar tool. The teeth 40 indent the external surfaces of the head 32 of threaded fastener, supplying the positive grip necessary to rotate and remove the threaded fastener.

To release the removed fastener from the tool, the user simply holds the socket extension 30 rigidly and rotates the outer barrel 16 in a direction to loosen the outer barrel 16 relative split collet socket 14. This will allow the collet ring 12 to relax and move down the tapered section 22 opening the fingers 21 and 23.

As is readily apparent, the user can apply the torque to the hex nut 26 of the outer barrel 16 directly without using a square drive socket extension 30. This action creates a self-tightening adjusting feature. This can be useful in applications where there is insufficient space available to use the square drive socket extension 30.

The procedures outlined above describes the removal of a right hand threaded fastener. Adjustable sockets of the present invention can be manufactured with right hand threads suitable for threaded fasteners having left hand threads.

The embodiment described above illustrates a two finger design. However, it is now readily understood that 3 or 6 fingers would also be suitable for the present invention. The preferred number of fingers is three, as illustrated in broken lines in FIG. 4. Three fingers provides a balance between the flexibility of the fingers and the forces required to deflect the fingers.

Many other modifications and purposes of this invention become readily apparent to those skilled in the art upon perusal of the foregoing description. It is to be understood that certain changes in style, size and components may be effective without a departure from the spirit of the invention and within the scope of the appended claims.

I claim:

1. An adjustable socket for removing a threaded fastener having a thread in a first sense, said socket comprising:

a cylindrical split collet socket having at least two spaced fingers at one end thereof and an external thread in a sense opposite said first sense at an opposite end thereof, said fingers having an external taper and an internal splined surface comprising axially extending V-shaped slots presenting a series of teeth, said internal splined surface being generally hex shaped, said fingers having side walls having areas of relative reduced thickness at corners of said hex shape to allow a degree of flexibility of said teeth, said split collet socket having, at said opposite end, a female drive opening for receiving a driver for applying a torque to said split collet socket, a collet ring mounted about ends of the fingers, said collet ring having an internal taper complementary to and cooperating with said external taper, said tapers align to deflect the fingers radially inwardly as the collet ring is urged along the split collet socket towards said one end of said split collet socket, and an outer barrel having an internal thread for threadably engaging said external thread of said split collet socket, said barrel receiving said split collet socket therewithin and having one end of the barrel frictionally engaging said collet ring, said barrel having at least two flat surfaces suitable for receiving a wrench for applying a torque thereto, said barrel having an opening in an opposite end thereof allowing access to said female drive of said split collect socket, whereby rotation of the barrel relative to said split collet socket in one sense urges said collet ring to close said fingers for gripping a head of said threaded fastener, continued relative rotation of the barrel in the one sense increases said grip urging said splines to indent an exterior surface of the threaded fastener, and applies a torque to the threaded fastener for removal thereof and counter rotation of the barrel relative to the split collet socket relaxes the collet ring allowing removal of the head of the threaded fastener.

* * * * *